United States Patent [19]

Christensen

[11] 4,455,895

[45] Jun. 26, 1984

[54] BEVERAGE CAN OPENER TOOL

[75] Inventor: Robert F. Christensen, Miles City, Mont.

[73] Assignees: Clyde M. McFarland; Joyce J. Janssen; Shirley I. Gibson, all of Miles City, Mont.

[21] Appl. No.: 412,526

[22] Filed: Aug. 26, 1982

[51] Int. Cl.[3] ..... B67B 7/40

[52] U.S. Cl. ..... 81/3.46 R; 81/3.1 R; 7/901; D8/18

[58] Field of Search ..... 81/3.46 R, 3.46 A, 3.1 R, 81/3.34, 3.4; 7/151, 169, 901; D8/16, 18, 33, 40

[56] References Cited

U.S. PATENT DOCUMENTS

| | | | |
|---|---|---|---|
| 1,432,670 | 10/1922 | Cole | 81/3.46 A |
| 1,609,732 | 12/1926 | McLaughlin et al. | 7/169 |
| 1,827,679 | 10/1931 | Stuart | D8/18 |
| 2,860,533 | 11/1958 | Lydon | 81/3.46 R |
| 3,204,907 | 9/1965 | Tattrie | 7/105 |
| 3,656,375 | 4/1972 | Reed | 81/3.46 R |
| 4,133,228 | 1/1979 | De Pooter | 81/3.1 R |
| 4,207,781 | 6/1980 | Greenwood | 81/3.46 R |
| 4,253,352 | 3/1981 | O'Neal | 81/3.46 R |
| 4,309,921 | 1/1982 | Miller | 81/3.46 R |
| 4,373,246 | 2/1983 | Van Houtte | 81/3.46 R |

*Primary Examiner*—Roscoe V. Parker
*Attorney, Agent, or Firm*—Harvey B. Jacobson

[57] ABSTRACT

A beverage can opener tool for opening a container having a pull tab attached to a non-removable section of the beverage can top for opening the container for beverage consumption. The tool is a thin, rigid bar of metal that is generally flat throughout an intermediate portion and end portions which are interconnected by offset connecting portions. The tool is of unitary construction and devoid of cavities, recesses or crevices for collection of foreign matter, and the tool is easily cleaned and does not become dirty under normal use.

4 Claims, 5 Drawing Figures

BEVERAGE CAN OPENER TOOL

BACKGROUND OF THE INVENTION

1. Field of the Invention

The present invention relates to a beverage can opener tool for opening a container having a pull tab which is attached to an openable section located in the top of the container. More particularly the invention is directed to a tool constructed of a rigid bar with an intermediate portion terminating in an offset bend at each end with the offset bends terminate in end portions extending in opposite axial directions sufficiently far enough apart for each to selectively engage under the pull tab when that end portion is inserted under the tab while in generally perpendicular relation thereto. The offset bend at each end facilitates the tool being easily picked up when the tool is resting on a flat surface since the end portions support the tool with the intermediate portion sufficiently raised for the tool to be conveniently picked up with either end being immediately available for use without the tool being shifted, translated or adjusted to another position. The offset bends of each end of the intermediate portion tend to keep one's hand from slipping while the tool is in use with forces being applied for raising the pull tab. Thus, the offset bends allow the flat end portions of the tool to be received under the pull tab which is recessed below the top edge of the circular rim with the offset bend enabling the end portion to be positioned under the pull tab. The flat portions are bent up slightly, about 2°–7° from the plane of the flat intermediate portion, and this tends to facilitate use of the tool in such a position as to give a straight pull to force the end portion under the tab and to facilitate a twisting force to be exerted on the tool to pivot the tab upwardly and thus force the openable section of the can top downwardly in a well known manner. Corners of the flat ends of the tool may be tapered so that they are easily insertable under the pull tabs especially where such pull tabs are positioned in substantially recessed areas below a circular rim or other rim construction of a beverage can.

2. Description of the Prior Art

Various beverage can opener tools and the like are known and the following U.S. patents are exemplary of the prior art:

U.S. Pat. No. 1,432,670, A. L. Cole
U.S. Pat. No. 3,656,375, J. A. Reed et al
U.S. Pat. No. 4,133,228, C. E. DePooter
U.S. Pat. No. 4,207,781, P. R. Greenwood
U.S. Pat. No. 4,253,352, G. L. O'Neal
U.S. Pat. No. 4,309,921, R. W. Miller The patent to Miller discloses a metal body that is generally flat but with a bend in a rear end and having a nose end adapted to be disposed over the tab handle so that the handle is received in the downwardly offset bridge. The bridge is adapted to be inserted under the container tab and upon raising, the body lifts the tab as the nose end imposes a downward pressure and opens the closure without excessive force being applied. The O'Neal patent discloses a flattened tube open at both ends for engagement with a container opening tab. The other patents are of a more general interest relating to container opening devices. None of the patents discloses in combination a generally symmetrically arranged offset structure common for left-handed or right-handed opening of a beverage can and having absence of recesses and cavities for retention of foreign matter, food and the like. None of these patents discloses all of the specific details of the present invention in such a way as to bear upon the patentability of any claims of the present invention.

SUMMARY OF THE INVENTION

An object and advantage of the present invention is to provide a beverage can opener tool having symmetrically disposed offset bends in the tool that facilitate inserting an end portion under a pull tab in proper relation therewith without slipping off the tab when lifting, due to a slight upwardly inclined orientation of the flat end portions with respect to an intermediate flat portion of the tool.

Another object and advantage of the present invention is to provide a beverage can opener tool that allows left-handed or right-handed bartenders and other users of the tool to open pull tab beverage cans quickly without having to raise the pull tab by using and abusing fingernails which may become sore after protracted use.

In the development of pull tab openers for beverage cans, the present state of the art utilize beverage cans with non-detachable openable sections and pull tabs in the top of the container. Normally, a thumb nail or fingernail is used to lift the pull tab when opening the beverage can. Continued use of fingernails for lifting up pull tabs causes the fingernails and adjacent areas of the thumbs or fingers to become sore.

A further object and advantage of the present invention is to provide a simplistic and elemental beverage can opener tool particularly adaptable for opening beverage cans with non-detachable openable sections and pull tabs. The tool is used by holding the tool in either hand and inserting an end portion beneath a pull tab while an offset bend portion of the tool is positioned within the circular rim of the beverage can. In raising the pull tab to its upright position so that the openable section of the container top is punched downwardly into the container, the tool is turned about its longitudinal axis while maintaining the end portion against the pull tab. The tab may then be returned toward its original position using one thumb when removing the tool.

Still another object of the present invention is to provide a tool having an intermediate flat portion and distal flat end portions interconnected by offset members so that the the tool is easily picked up and the tool is available for immediate use. The offset bends in each end of the tool provide ease in picking up the tool from a smooth surface quickly and prevents the possibility of the fingers slipping on the tool while yet allowing a chosen or selected end of the tool to be slipped or inserted under the pull tab, the pull tab being located in a recessed top surface beneath a circular rim of the beverage container or can. Thus, the tool is of simple construction, easy to manufacture and inexpensive in manufacturing costs. A magnet can be installed on a center of the tool, particularly the side having the offset bends extending therefrom, and the magnet will allow the tool to adhere to any steel or iron object such as a beverage can cooler. The tool is easily kept or maintained where it is conveniently available to beverage can users and bartenders and in certain circumstances can be maintained or stored in spaces not available to the customer and thus reduce the problem of losing the tool.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
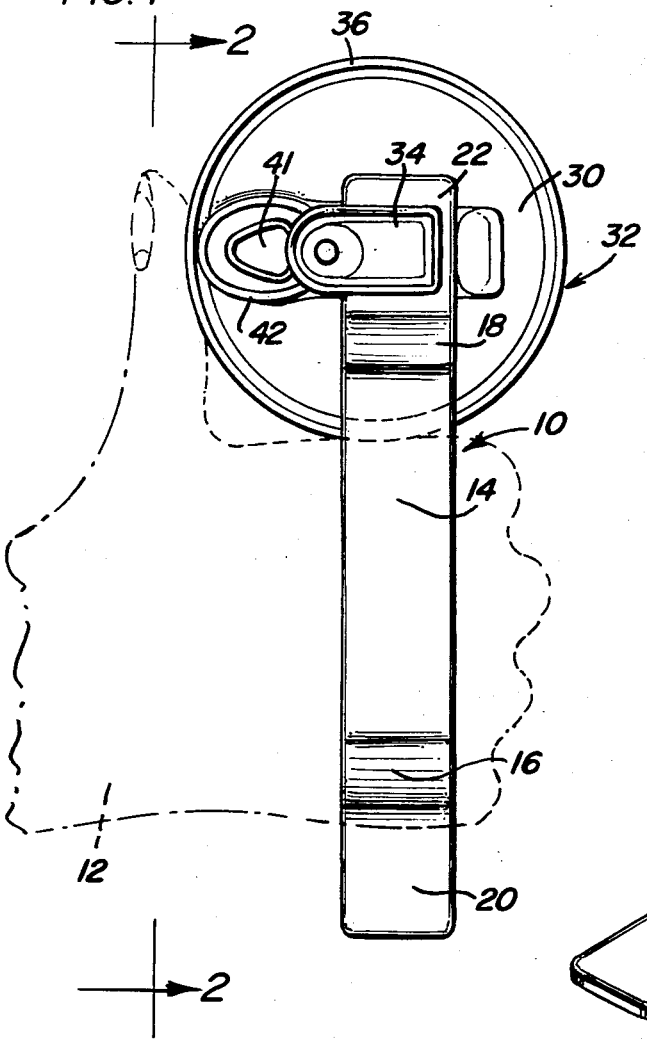
FIG. 1 is a top plan view of a beverage can opener tool inserted under a pull tab of a beverage can according to the invention.

Referring now to the drawings, there is shown a beverage can opener tool 10 held in one's hand 12 and in which the tool contains a generally flat intermediate portion 14, a set of two symmetrically disposed offset bends or offset members 16, 18 integrally coupled to terminal portions or end members 20, 22 of the tool 10.

The beverage can opener tool 10 may be constructed of a material such as rigid plastic, metals such as aluminum and the like, or other substantially rigid material. The edges of the tool 10 throughout are slightly bevelled or rounded and the edges of the end members 20, 22 are particularly constructed and adapted for reception in a recess formed in a top surface 30 of a beverage container or can 32 in underlying relation to a pull tab 34. The top surface 30 is located below an outer edge or rim 36 of the can 32, and by reason of the offset members 16, 18 extending angularly from the flat surface of either of the end members 20, 22, entry of the end members 20 and 22 between the top surface 30 and the pull tab 34 is facilitated.

The surface of the intermediate portion 14 and the surfaces of the end members 20, 22 are generally parallel, but in order to facilitate opening or raising of the pull tab 34, each of the end members 20, 22 are displaced angularly upwardly at an angle of about 2°–7° from the plane containing the inner ends of end members 20, 22.

The offset members 16, 18 are integrally formed with the intermediate member 14 and the end members 20, 22 and the tool is generally symmetrical about a plane passing through a center area or point of tool 10.

Figure 3:
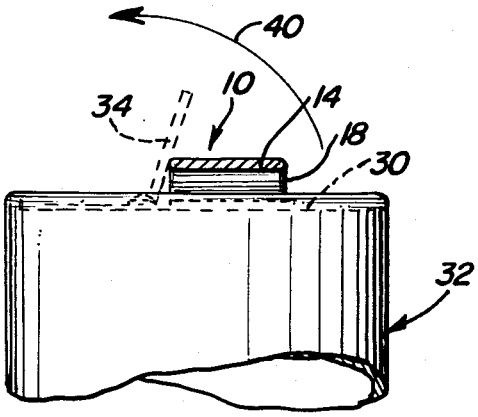
FIG. 3 is a sectional view taken along section line 3—3 of FIG. 2.
Figure 5:
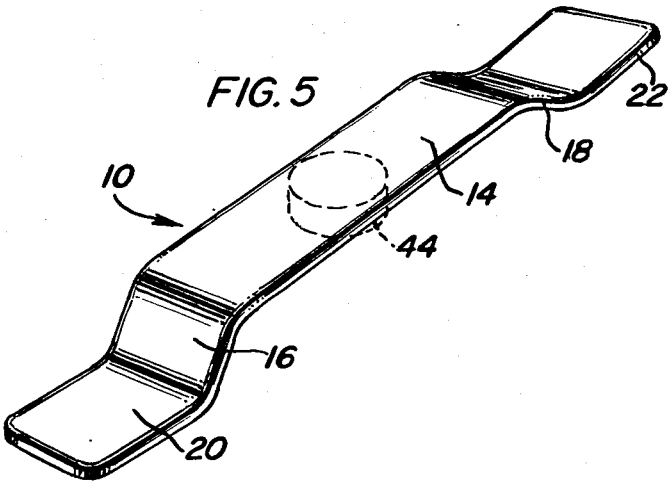
FIG. 5 is a perspective view of the beverage can opener tool illustrating an optional magnet.

The tool is adaptable to right-handed or left-handed use, and FIG. 1 shows the tool 10 in use by a right-handed user and in which the tool 10 is to be twisted generally about its longitudinal axis after insertion under a pull tab 34 as indicated by arrow 40 in FIG. 3.

Figure 2:
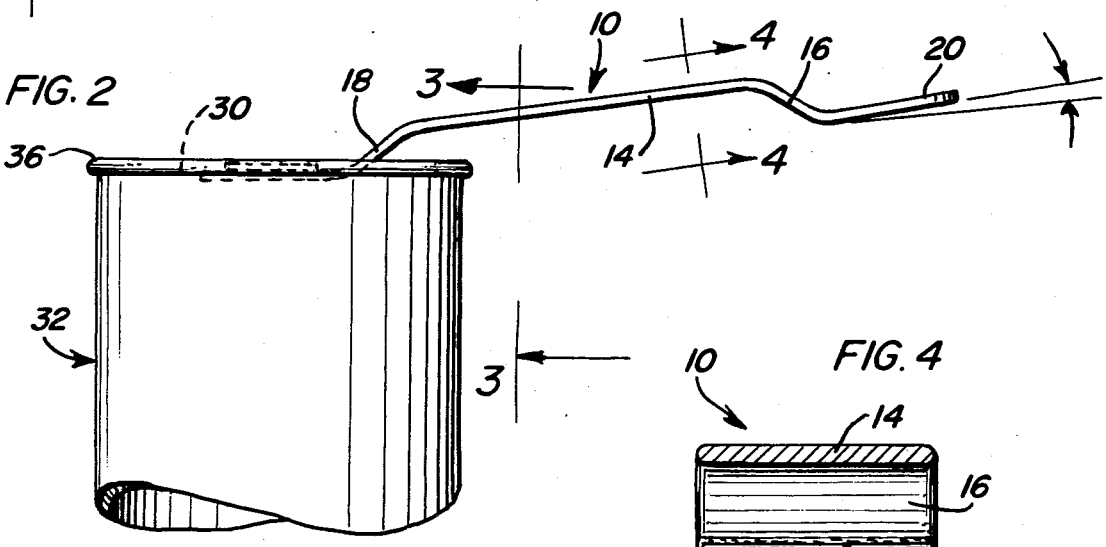
FIG. 2 is a side elevational view of the tool and can taken along reference line 2—2 of FIG. 1.
Figure 4:
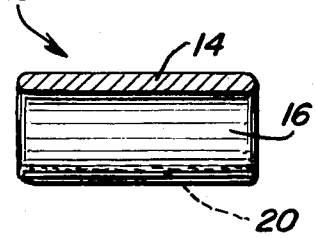
FIG. 4 is a sectional view taken along section line 4—4 of FIG. 2.

In operation and use of the invention, the tool can be picked up with either hand of the user so that either end member or portion 20, 22 is adaptable for opening the beverage can. The end member 22 is inserted beneath the pull tab 34 and engaging the top surface 30 such that the tool is approximately at a right angle with respect to the pull tab 34. The thumb is then placed along an outer edge of the can in line with the pull tab 34 and pressure is exerted between the thumb and the fingers of the user to force the end member 22 completely under tab 34. The tool is twisted while maintaining the tool in position as it pivots in the manner shown by arrow 40. This provides a straight pull on the pull tab 34, raising the pull tab to an upright position shown in dotted line in FIG. 3 so that the openable section 41 is separated downwardly along the scored line of weakening 42 thus forming a hole or opening in the can by the pull tab 34 having its leading edge depress the section 41 within the scored line 42 and the beverage within the can 32 is then available for consumption. The pull tab 34 is then capable of being returned to its original position along the top surface 30 by pushing it back with one's thumb as the tool 10 is removed. The slight up-bends of the members 20, 22 as shown in FIG. 2 are such that the tool will maintain the end portion under the pull tab 34 in proper orientation and proximity with the top surface 30. If the up-bend of end members 20, 22 is insufficient, the tool will have a tendency to slip off the pull tab when lifting, and if the end members 20, 22 of the tool 10 are bent upwardly too much, the pull tab 34 is found to have a tendency to twist sideways and it will also be more difficult to insert the tool 10 beneath the pull tab 34 and along the top surface 30. As illustrated in FIG. 4 a circular magnet 44 is attached to the under surface of the intermediate portion 14 to provide an optional structure for supporting the tool from ferrous surfaces, objects and the like. Also, a small hole may be provided in either end of the intermediate portion so that it can be conveniently hung on a nail or a similar support. Further, the tool may be used to open containers of a similar type having products other than beverages therein.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A can opener tool for opening a container having a pull tab which is attached to an openable section located in the top of the container, the tool comprising a rigid bar including a substantially planar elongate handle portion and a substantially planar terminal portion at one end of the handle portion, the terminal portion being adapted to fit under a container tab and being offset downwardly from the handle portion by means of a bend in the bar, the terminal portion extending upwardly toward its free end at an angle in the range between about 2° and 7° to the plane of the handle portion.

2. A can opener tool for opening a container having a pull tab which is attached to an openable section located in the top of the container, the tool comprising a rigid bar including a substantially planar elongate handle portion and substantially planar terminal portions symmetrically disposed at opposite ends of the handle portion, each terminal portion being adapted to fit under a container tab and being offset downwardly from the handle portion by means of a bend in the bar, each terminal portion extending upwardly toward its free end at an angle to the plane of the handle portion, wherein each terminal portion extends upwardly toward its free end at an angle in the range between about 2° and 7°.

3. The invention of claim 2 wherein the tool includes a magnet on the undersurface of the handle portion.

4. In combination with a container having a pull tab attached to an openable section located in the top of the container, a can opener tool for opening the container, the tool comprising a rigid bar including a substantially planar elongate handle portion and a substantially planar terminal portion at one end of the handle portion, the terminal portion being offset downwardly from the handle portion by means of a bend in the bar and extending upwardly toward its free end at an angle of between about 2° and 7° to the plane of the handle portion, the terminal portion being positioned under the container tab with the longitudinal axis of the tool disposed substantially orthogonally in relation to the longitudinal axis of the tab, its handle portion extending over and beyond the rim of the container whereby it may be gripped in the hand of a user and used to open the container by twisting the tool substantially about one longitudinal edge thereof, thereby lifting the tab.

* * * * *